United States Patent [19]

Olsson

[11] Patent Number: 4,560,221

[45] Date of Patent: Dec. 24, 1985

[54] HIGH DENSITY ZERO INSERTION FORCE CONNECTOR

[75] Inventor: Billy E. Olsson, New Cumberland, Pa.

[73] Assignee: AMP Incorporated, Harrisburg, Pa.

[21] Appl. No.: 609,916

[22] Filed: May 14, 1984

[51] Int. Cl.[4] ..... H01R 9/09

[52] U.S. Cl. ..... 339/75 MP; 339/176 MP

[58] Field of Search ..... 339/75 MP, 176 MP, 74 R

[56] References Cited

U.S. PATENT DOCUMENTS

| | | | |
|---|---|---|---|
| 3,329,925 | 7/1967 | Johnson et al. | 339/91 |
| 3,526,869 | 9/1970 | Conrad et al. | 339/176 MP |
| 4,080,027 | 3/1978 | Benasutti | 339/75 MP |
| 4,116,516 | 9/1978 | Griffin | 339/75 MP |
| 4,159,861 | 7/1979 | Anhalt | 339/75 MP |
| 4,192,571 | 3/1980 | Strautz | 339/103 M |
| 4,288,139 | 9/1981 | Cobaugh et al. | 339/176 MP |
| 4,386,815 | 6/1983 | Carter et al. | 339/75 MP |
| 4,451,818 | 5/1984 | Grabbe et al. | 339/75 MP |

*Primary Examiner*—John McQuade

*Attorney, Agent, or Firm*—Russell J. Egan; Robert W. Pitts

[57] ABSTRACT

A zero insertion force connector capable of high density interconnection is formed by a pair of contact assemblies each actuated by a respective cam assembly and mounted in a housing. Each contact assembly is formed by first and second elongated rigid contact members held in spaced relationship by several strips of terminals formed by plural terminals fixed in parallel spaced array on an insulative web. One contact member is fixed to a mother circuit board and the other contact member is engaged by the cam assembly which interacts with the walls of the housing to drive the other contact member normal to the surface of a daughter circuit board received in the connector.

7 Claims, 5 Drawing Figures

HIGH DENSITY ZERO INSERTION FORCE CONNECTOR

The present invention relates to a zero insertion force, high density, mother/daughter circuit board connector and in particular to a connector employing multiple layers of laminated formed terminals.

The trend in electronics has been to go to higher and higher densities of interconnects. This clearly limits the amount of space which is available for use in making the interconnect. Some of the previous attempts at making mother/daughter circuit board connectors having high density capabilities have utilized approaches involving of flat flexible circuitry. One example of this may be found in U.S. Pat. No. 3,401,369 which shows a sheet of dielectric material one side of which is laminated to the inner surface of a channel-shaped spring member. The other surface of the sheet has a patterned array of conductive paths plated thereon. One end of each path is terminated by a pin terminal while the opposite end is spring loaded by the channel-shaped member to engage an appropriate pad of a circuit board received in the connector. This connector has a number of disadvantages including the fact that it is not zero insertion force and that wiping forces of significant magnitude to damage the circuitry, during insertion of the daughter circuit board, can be generated.

Another board-to-board connector is shown in U.S. Pat. No. 3,967,162. This connector utilizes flat flexible circuitry which is patterned with an array of conductive paths and placed on the outside of an elastomeric member. The elastomeric member is placed between two stacked circuit boards and, when the board are compressed together, will contact the circuit patterns such that a circuit on the first board will be connected to a circuit on the second board. The primary idea of this invention is to have a plurality of conductive paths such that there will be overlapping between the conductive paths and the circuit board patterns to insure connection is made between the circuit boards.

U.S. Pat. No. 3,609,463 discloses a further attempt at using flexible circuitry as a board-to-board interconnect. In this invention a separate spring is used to drive a follower member against flexible circuitry and hold it in the insertion path of a circuit board. This is not a zero insertion force connector and is subject to the previously mentioned possible damage during insertion.

Examples of zero insertion force connectors having longitudinally extending and actuated camming means may be found in U.S. Pat. Nos. 4,077,688, 4,077,694 and 4,288,139. In each of the devices disclosed by these patents, the cam acts directly on the terminal thereby requiring the terminal to have sufficient structure as to be stiffly resilient and prohibiting a high density arrangement of such terminals.

The present invention overcomes many of the difficulties of the prior art by providing a zero insertion force connector which has terminals in a high density arrangement. The subject connector includes a housing of insulative material having one face mountable on a mother circuit board and oppositely directed face defining an elongated cavity adapted to receive a daughter circuit board. A daughter board receiving and positioning member is located within the cavity substantially centrally of the mother circuit board engaging face. On each side of the daughter board receiving member is an elongated board contact assembly each formed by a pair of elongated insulative contact members having an array of terminal apertures therein. Each contact assembly also includes a plurality of strips of terminals, each terminal individually bonded to a web of insulative material in parallel spaced fashion. The strips of terminals are mounted with one end of each terminal extending through a respective aperture in each contact member, the strips of terminals being in an overlaying configuration with the insulative web performing an electrical isolation feature. A pair of cam assemblies are positioned in the cavity between the side walls of the housing and the respective member half of the contact assemblies. Each cam assembly comprises a pair of mutually profiled elongated members which, when move laterally with respect to one another, mutually separate and a resilient pad directly engaging the contact member. The cam assembly further includes cam actuation means exterior of the housing.

The present invention will be described by way of example with reference to the accompanying drawings in which.

Figure 1:
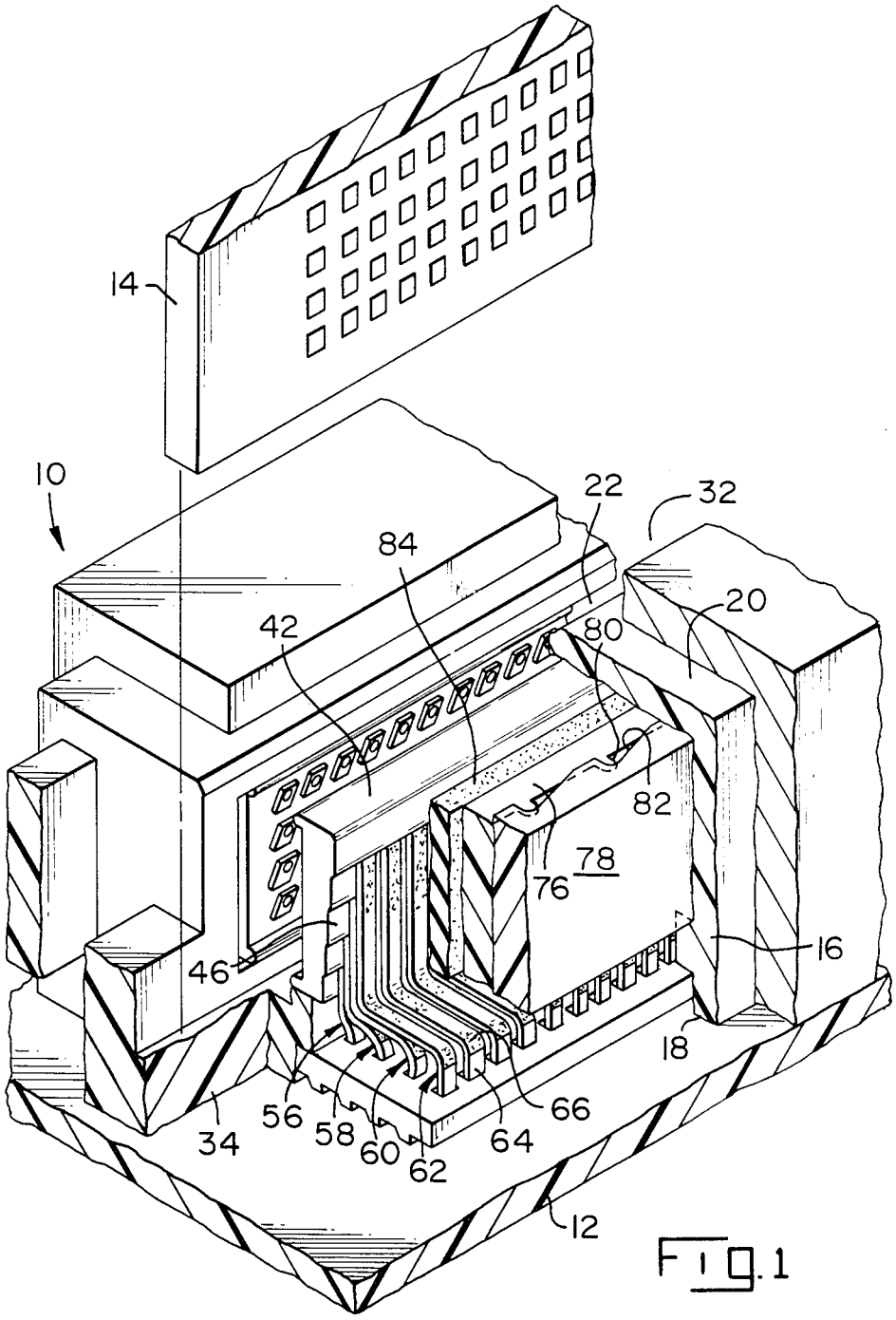
FIG. 1 is a perspective view of the present invention, partially in section.
Figure 4:
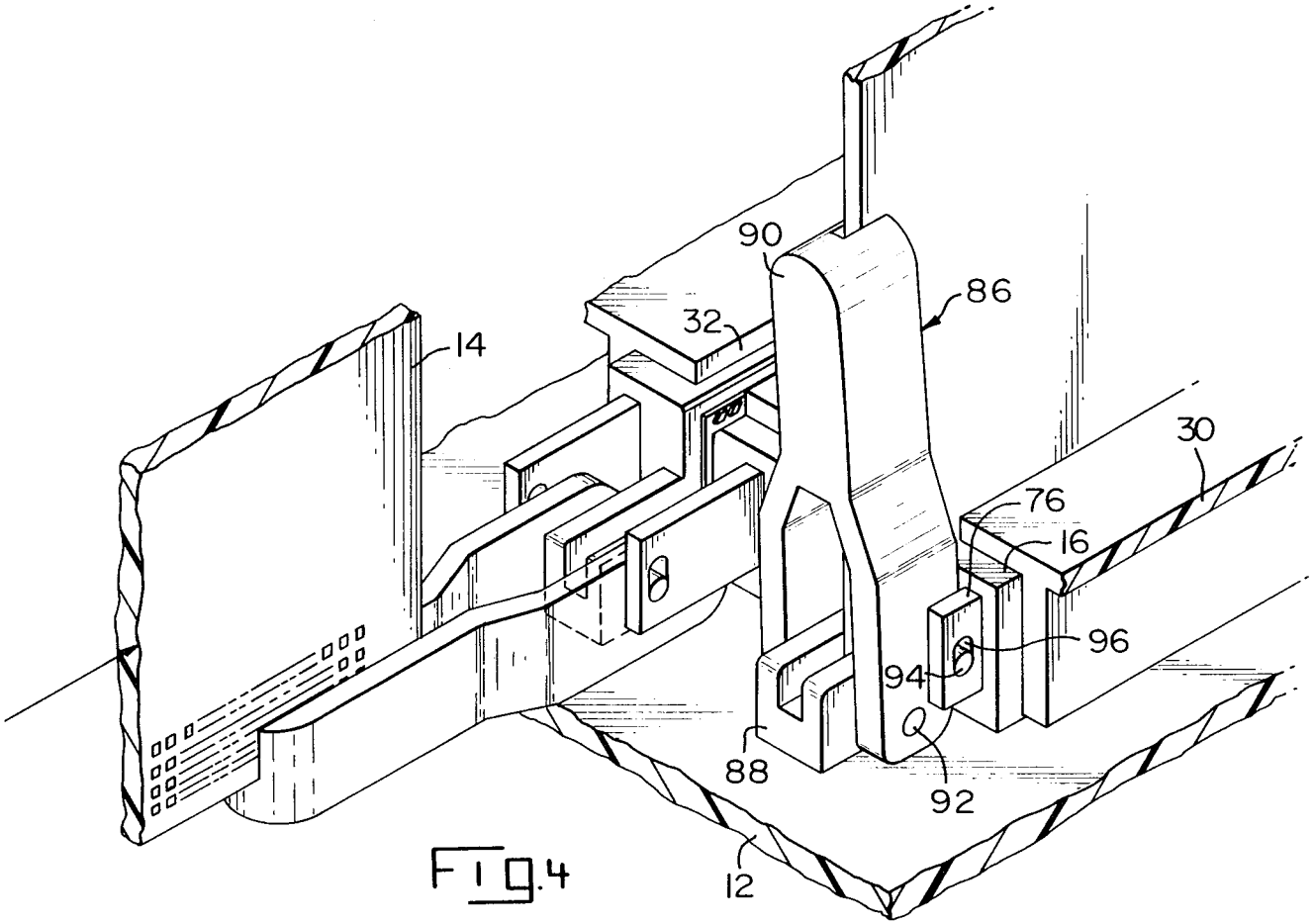
FIG. 4 is a perspective view of one end of the subject connector showing the cam actuation mechanism.
Figure 5:
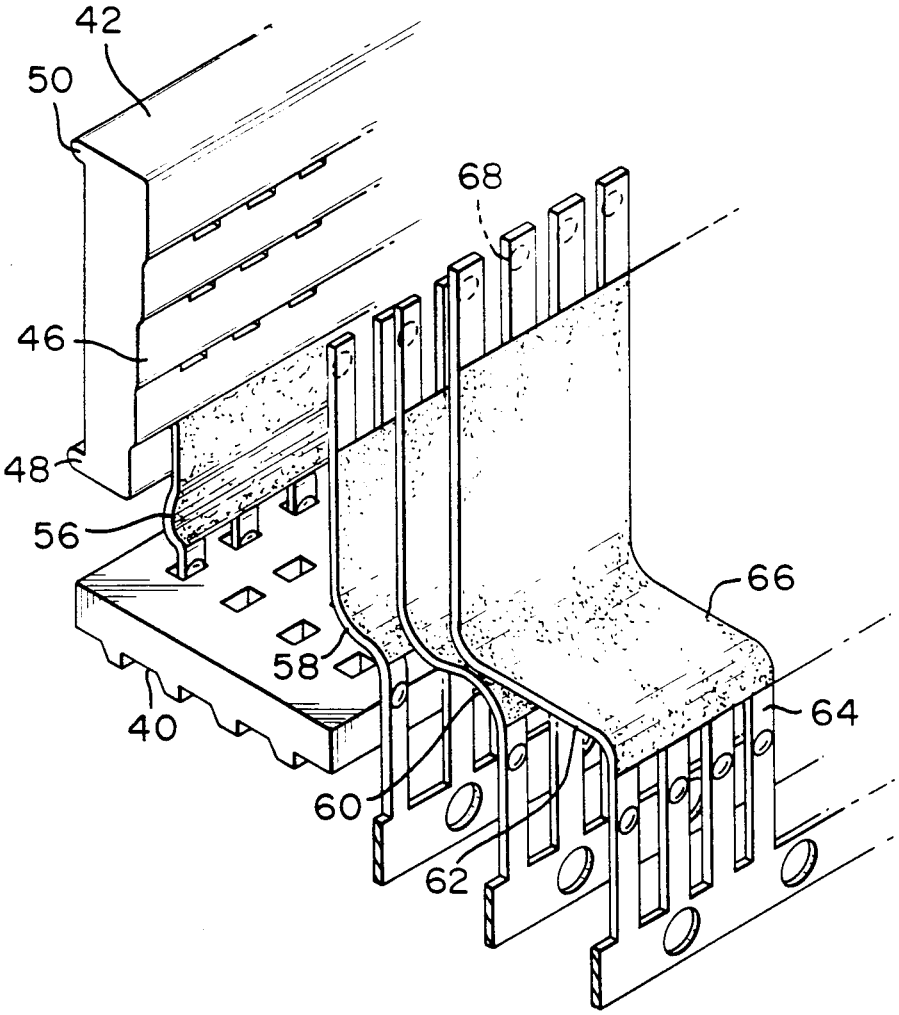
FIG. 5 is a partially exploded perspective view of a contact assembly according to the present invention.

Turning now to FIG. 1, the subject connector 10 has been shown mounted on mother circuit board 12 and adapted to receive a daughter circuit board 14. The subject connector 10 includes an elongated housing 16 of insulative material defining a mother circuit board engaging face 18 and a daughter board receiving face 20 having an elongated central aperture 22. The housing 16 also defines central cavity 24, bonded by profiled lateral walls 26, 28. The housing 16 has been shown secured to the mother circuit board 12 by a metal frame 30 having a slot 32 aligned with the aperture 22 in the housing. Centrally disposed in the cavity 24 at the mother board engaging face is a daughter board receiving and positioning member 34 having an elongated groove 36 aligned opposite the aperture 22. To each side of the member 34 there is a terminal assembly 38, 40, each formed by an elongated first contact member 42 of rigid insulative material having an array of apertures 44 therein, the apertures 44 being in parallel spaced rows opening on to the stepped profiled surface 46 of the member 42. The member 42 also includes forwardly directed stops 48, 50. An elongated second contact member 52 is formed of rigid insulative material and has a like plurality of arrays of apertures 54. Each terminal assembly 38, 40 also includes a plurality of strips of terminals 56, 58, 60, 62 with each strip formed by plurality of parallel spaced stamped and formed metal terminals 64 adhered in fixed relation to a web of insulative material 66. The webs are not complete in FIG. 1 and are more completely shown in FIG. 5. Each end of each terminal 64 is received in respective aperture 44, 54 with the end 68 profiled for engagement with a pad on the daughter circuit board 14 and the end 70 profiled for surface mount against the mother circuit board 12. The connector 10 also includes a pair of cam assemblies 72, 74 each comprising a pair of elongated rigid cam members 76, 78 each having a profiled face 80, 82 which are mutually engaging and which, when the cam members 76, 78 are moved longitudinally with respect to one another, cause a relative transverse to opening and closing movement of the cam members 76, 78. Each cam assembly 72, 74 also includes a resilient pad 84 positioned between the cam member 76 and the respective first contact member 42. A cam actuation means 86 is shown in FIG. 4. It includes a bracket 88, which is secured to the end of housing 16, and a handle 90, which is pivotally mounted on the bracket 88 by pivot 92. The handle 90 is provided with pins 94 which are received in elongated slot 96 at the ends of cam members 78.

The present invention is assembled by first forming the contact assemblies 38, 40. This is accomplished by forming the individual strips of terminals 56,58,60,62 by stamping and forming a strip of terminals 64, bonding a web 66 of insulative material along at least one side of the terminals 64 to hold them in fixed parallel spaced arrangement, and then completing forming the terminals 64 and serving all carrier strips (not shown) therefrom. It should be noted that the terminals 64 can also be plated, for example, on end with 70 a material having soldered affinity and on end 68 with a noble metal. A method for accomplishing the formation of the strips of terminals is disclosed in U.S. Pat. No. 4,028,794, the disclosure of which is incorporated herein by reference.

The ends 68, 70 of the respective terminals 64 are then passed through the apertures 44 in the first contact member 42 and the apertures 54 in the second contact member 52 in sequence. It will be appreciated that the two members 42,52 are separate and that the member 42 is supported for movement with respect to the member 52 by the terminal strips 56,58,60,62.

The pair of contact assemblies 38, 40 are placed on opposite sides of the daughter board receiving and positioning member 34 on the mother circuit board 12 and terminal ends 70 are preferably soldered in place by any of the well known techniques, such as vapor phase soldering. It may be necessary to utilize a fixturing appliance during this step because of the free standing arrangement of the member 42. Next the cam assemblies 72,74 are loaded into the housing 16 and the assembly thereof placed on the prepositioned contact assemblies 38,40 and member 34.

Figure 2:
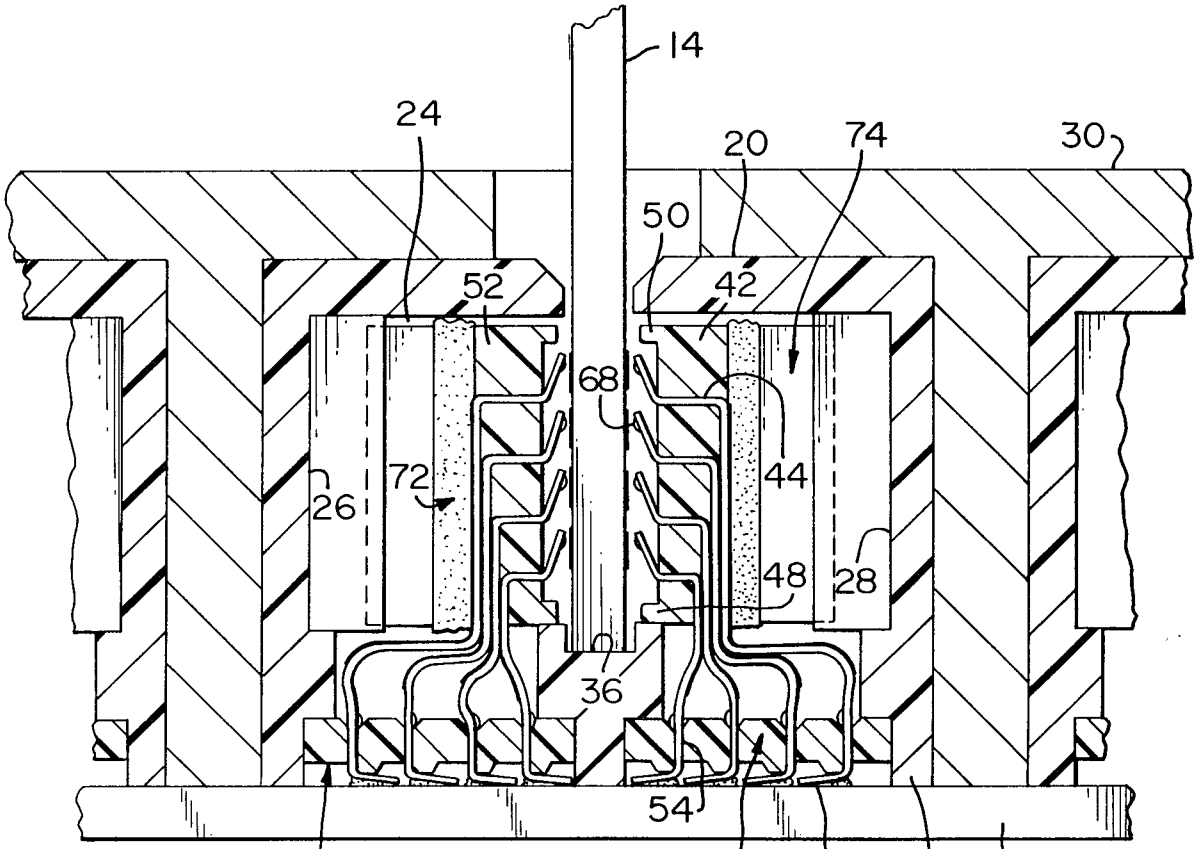
FIG. 2 is a transverse section through the present invention in an open or noncontacting condition.
Figure 3:
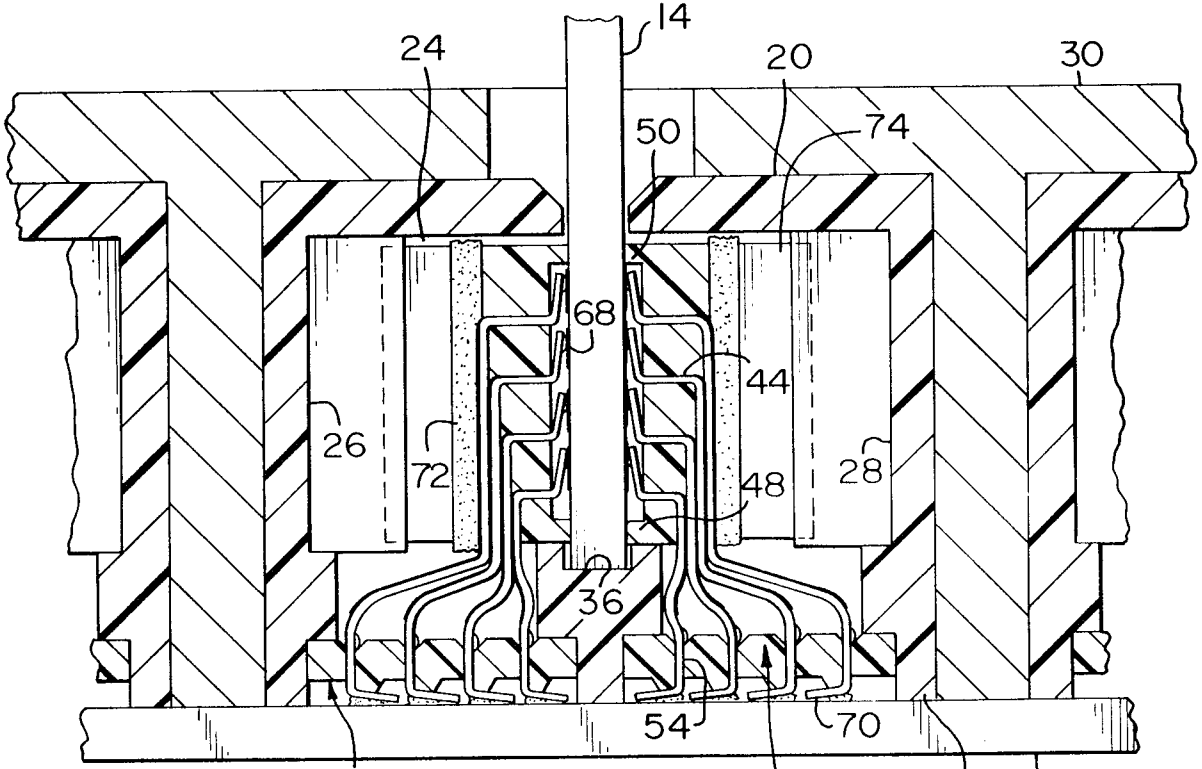
FIG. 3 is similar to FIG. 2 but showing the connector in a closed or actuated condition.

The operation of the present invention will be appreciated from a comparison of FIGS. 2 and 3. In FIG. 2 the connector 10 is shown in an open condition in which the daughter circuit board 14 can be freely inserted into the aperture 22. In FIG. 3 the cam assemblies 72,74 have been actuated to drive the members 42 of the contact assemblies 38,40 towards the daughter circuit 14 board to make contact therewith. The combination of the angled ends 68 of the terminals 64 and the resilient pads 84 serve to assure adequate contact pressure as well as to accommodate for any irregularities or warpage in the daughter circuit board 14.

It shall be noted that the stacked assembly of terminal strips 56,58,60,62 allows the subject connector 10 to meet certain impedance requirements. This is accomplished by the length and spacing achieved by the insulative web 66.

I claim:

1. A zero insertion force mother/daughter board circuit connector having very high contact density capabilities, said connector comprising:

an elongated housing of rigid insulative material defining a mother circuit board receiving face and an oppositely directed daughter circuit board receiving face having an elongated aperture therein, said housing further defining an interior cavity;

a daughter circuit board receiving member secured in said housing opposite and spaced from said aperture;

a pair of contact assemblies mounted in said cavity in opposition on opposite sides of said daughter circuit board receiving member;

a like pair of cam assemblies each mounted in said cavity between an outer wall thereof and a respective contact assembly, wherein each said contact assembly comprises first and second elongated insulative contact members each having a plurality of passages therein in parallel spaced rows, and a plurality of terminal strips each comprising a plurality of terminals fixed in parallel spaced relation on a web of insulative material, each said terminal having one end received in an aperture in each said insulative member; and means to actuate said cam assemblies to drive portions of said contact assemblies into engagement with a daughter circuit board received in said connector.

2. The connector according to claim 1 wherein a first end of each said terminal is profiled for surface mounting on a mother circuit board.

3. The connector according to claim 2 wherein said first end is coated with material having solder affinity.

4. The connector according to claim 1 wherein a second end of each said terminal is profiled to engage a daughter circuit board.

5. The connector according to claim 4 wherein said second end of each said terminal is plated with a nobel metal.

6. A connector according to claim 1 wherein each said cam assembly comprises first and second cam members each having a profiled mutually engaging face which, when said members are moved longitudinally with respect to each, other causes a spreading action of said members.

7. The connector according to claim 6 further comprising a resilient member disposed between each said cam assembly and a respective contact assembly whereby resiliency of contact engagement is assured.

* * * * *